US006856102B1

(12) United States Patent
Lin et al.

(10) Patent No.: US 6,856,102 B1
(45) Date of Patent: Feb. 15, 2005

(54) THREE-STAGE ELECTRONIC BALLAST FOR METAL HALIDE LAMPS

(75) Inventors: Tsai-Fu Lin, Pingtung (TW); Tsorng-Juu Liang, Tainan (TW); Hau-Chen Yen, Kaohsiung Hsien (TW)

(73) Assignee: Hitech Electronics Co., Ltd., Tainan Hsien (TW)

( * ) Notice: Subject to any disclaimer, the term of this patent is extended or adjusted under 35 U.S.C. 154(b) by 0 days.

(21) Appl. No.: 10/845,174

(22) Filed: May 14, 2004

(51) Int. Cl.[7] ..... G05F 1/00
(52) U.S. Cl. ..... 315/291; 315/209 R; 315/307
(58) Field of Search ..... 315/149, 209 R, 315/224, 290, 291, 307, 308, 360, 362, DIG. 7

(56) References Cited

U.S. PATENT DOCUMENTS 5,381,076 A * 1/1995 Nerone ..... 315/209 R
6,107,754 A * 8/2000 Kim ..... 315/291
6,188,177 B1 * 2/2001 Adamson et al. ..... 315/149

* cited by examiner

*Primary Examiner*—Tuyet Vo
*Assistant Examiner*—Jimmy Vu

(57) ABSTRACT

A three-stage electronic ballast for metal halide lamps mainly comprises a step-up converter, a step-down converter and a full-bridge DC-AC converter, wherein the step-down converter operates an inductor in a continuous boundary current mode to achieve reducing power loss and enhancing efficiency. Equipped with a micro processor, the electronic ballast further possesses the function of power regulation. The electronic ballast can be added with various protective functions without complex control circuits and sensing elements, thereby becoming a high-quality and low-cost electronic ballast for metal halide lamps.

3 Claims, 4 Drawing Sheets

THREE-STAGE ELECTRONIC BALLAST FOR METAL HALIDE LAMPS

BACKGROUND OF THE INVENTION

1. Field of the Invention

The present invention relates to electronic ballasts for metal halide lamps, and more particularly to an electronic ballast for metal halide lamps having a three-stage structure. The three-stage electronic ballast for metal halide lamps mainly comprises a step-up converter, a step-down converter and a full-bridge DC-AC converter, wherein the step-down converter operates an inductor in a continuous boundary current mode to achieve reducing power loss and enhancing efficiency. Equipped with a micro processor, the electronic ballast further possesses the function of power regulation. The electronic ballast can be added with various protective functions without complex control circuits and sensing elements, thereby becoming a high-quality and low-cost electronic ballast for metal halide lamps.

2. Description of the Prior Art

High-intensity gas-discharging lamps are widely used as light sources for indoor or outdoor illumination. Given its intensity, efficiency, duration and color, metal halide lamps have been used in department stores, supermarkets or in advertisement boards for providing high quality illumination.

The majority of the electronic ballasts for metal halide lamps of the prior art include a power factor correction circuit made of a step-up converter, a DC—DC step-down converter, a full-bridge DC-AC converter and an ignition circuit. Although circuitry structure of the prior art is similar to the three-state structure according to the present invention, its step-down converter is operated in a discontinuous current mode to lessen running down of switching elements. Because of appreciable variation in the characteristic of a metal halide lamp over running time and different manufacturers, it requires a wider design margin for operating the inductor of a step-down converter in discontinuous current mode. This results in high peak values of the inductor currents and therefore high power loss in the circuit. And, consequently, the electronic ballasts of the prior art have step-down converter of low efficiency and high operating temperature, which makes the electronic ballasts less durable.

SUMMARY OF THE INVENTION

Accordingly, the present invention discloses a three-stage electronic ballast for supplying steady power source for a metal halide lamp. The electronic ballast comprises a power factor correction circuit including a step-up converter, a DC step-down converter, a full-bridge DC-AC converter and a high-voltage ignition circuit. The three-stage electronic ballast for metal halide lamps has the advantage of reducing power loss and enhancing efficiency, thereby increasing the duration of the electronic ballast.

Therefore, the primary objective of the present invention is to provide a three-stage electronic ballast for metal halide lamps wherein the inductor of the step-down converter is operated in a continuous boundary current mode for enhancing work efficiency and reducing power loss.

The secondary objective of the present invention is to provide a three-stage electronic ballast for metal halide lamps capable of dealing with the variation in the characteristics of metal halide lamps due to different manufacturers and providing the metal halide lamps with a constant power.

To achieve above object, the present invention provide a three-stage electronic ballast for metal halide lamps. The device comprises a filter and rectification circuit connected to an input voltage source terminal for suppressing electromagnetic disturbances and rectifying an input voltage signal; a step-up converter disposed after the filter and rectification circuit, the step-up converter further comprising a push-pull transistor, a step-up inductor and a rectification diode and a filter capacitor; a step-down converter disposed after the step-up converter, the step-down converter further comprising an inductor, a diode, a capacitor and a transistor switch, the step-down converter controlling the current in the inductor at the boundary of continuity and discontinuity so as to lessen power loss and enhance operation efficiency; a DC-AC converter disposed after the step-down converter for providing an alternating square-wave voltage to a metal halide lamp; an ignition circuit using circuit elements including a step-up transformer and a capacitor to generate an electric voltage up to 3 kilo volts for discharging the metal halide lamp; and a micro processor for controlling the conducting rate of the step-down converter according to the product of output voltage and current of the step-down converter, whereby power regulation can be achieved; The three-stage electronic ballast for metal halide lamps can force the inductor in the step-down converter to operate in a continuous boundary current mode, whereby the peak value of the inductor current will be decreased, and whereby the transistor switch switches under zero current, significantly reducing power loss in switching.

The various objects and advantages of the present invention will be more readily understood from the following detailed description when read in conjunction with the appended drawings.

DETAILED DESCRIPTION OF THE PREFERRED EMBODIMENTS

Figure 1:
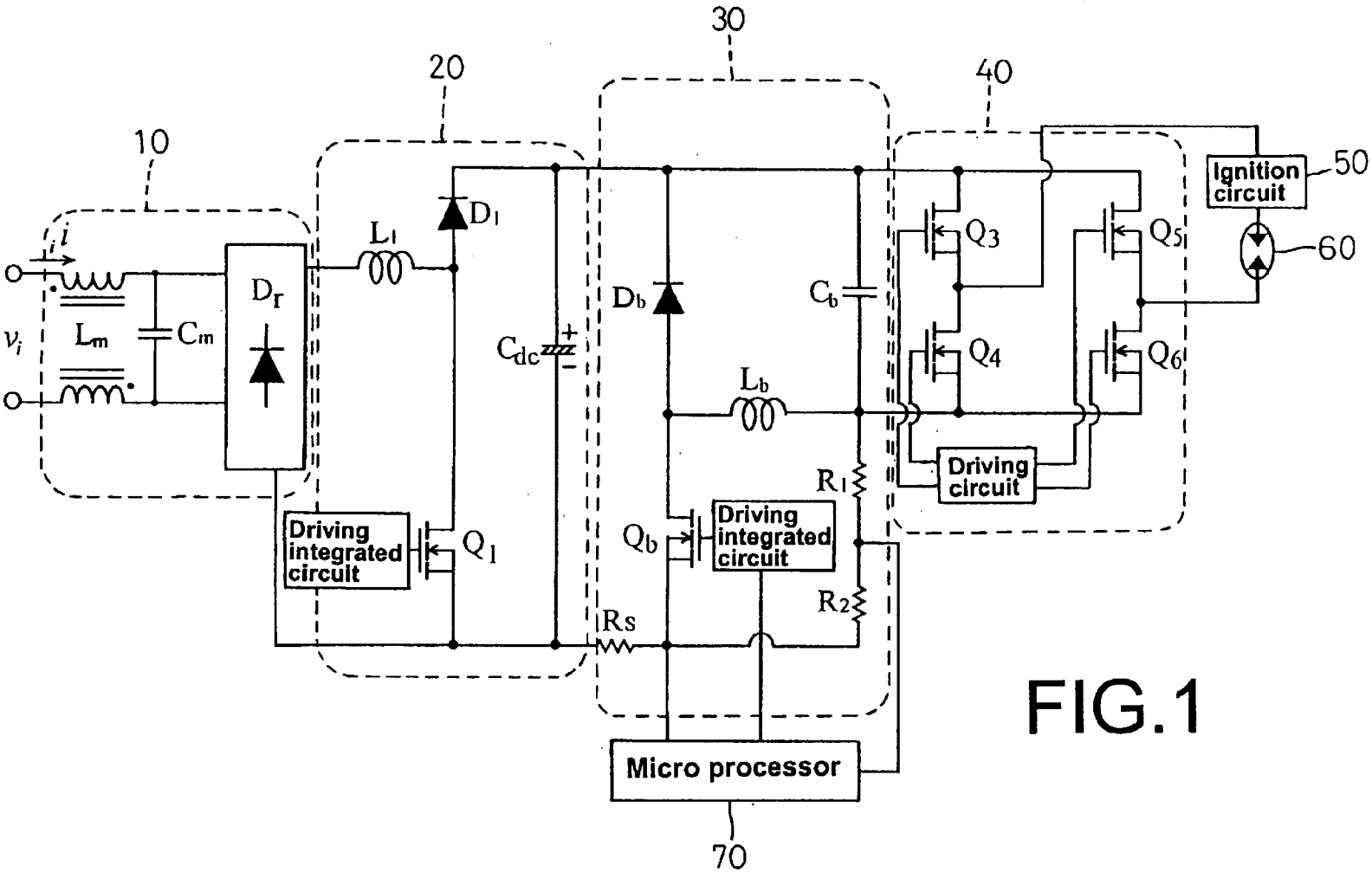
FIG. 1 is a circuitry diagram according to the present invention.

Referring to FIG. 1, a circuitry diagram according to the present invention utilizes a filter and rectification circuit 10 to filter and rectify an input commercial electric voltage Vi for suppressing electromagnetic disturbances. The voltage signal is then amplified by a step-up converter 20 and supplied to a step-down converter 30 for current control. The step-down converter 30 comprises a transistor switch Qb, a diode Db, an inductor Lb, a capacitor Cb and resistors R1, R2. A full-bridge DC-AC converter 40 is disposed after the step-down converter 30, which further includes transistor switches Q3, Q4, Q5 and Q6. A high-voltage ignition circuit 50, in series connection with a metal halide lamp 60, is disposed at the AC output terminal of the full-bridge DC-AC converter 40 for discharging the metal halide lamp 60.

Figure 2:
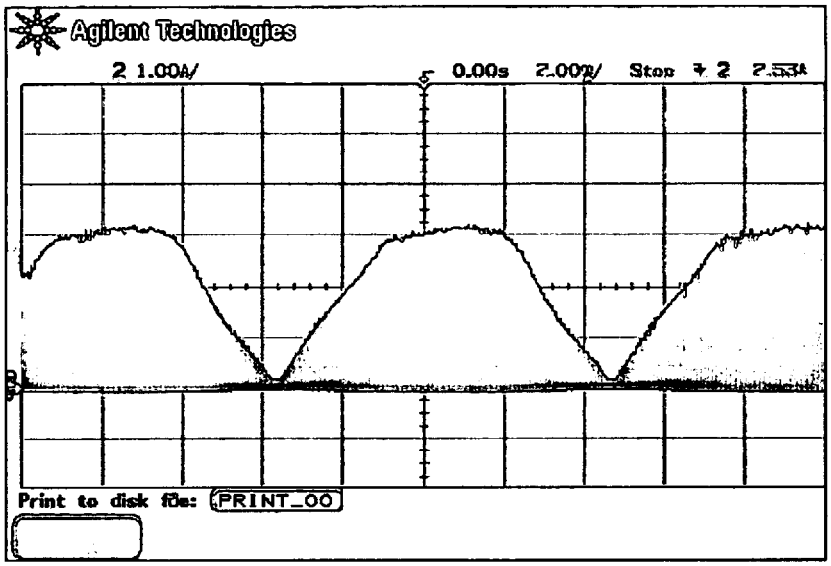
FIG. 2 is a wave diagram of the current through the step-up inductor in the preferred embodiment disclosed in FIG. 1.
Figure 3:
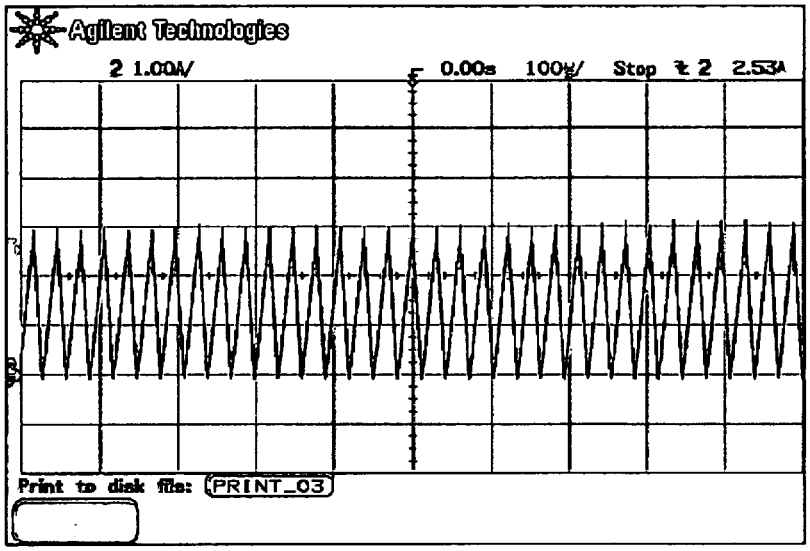
FIG. 3 is a local enlarged wave diagram of the current through the step-up inductor in the preferred embodiment disclosed in FIG. 1.
Figure 4:
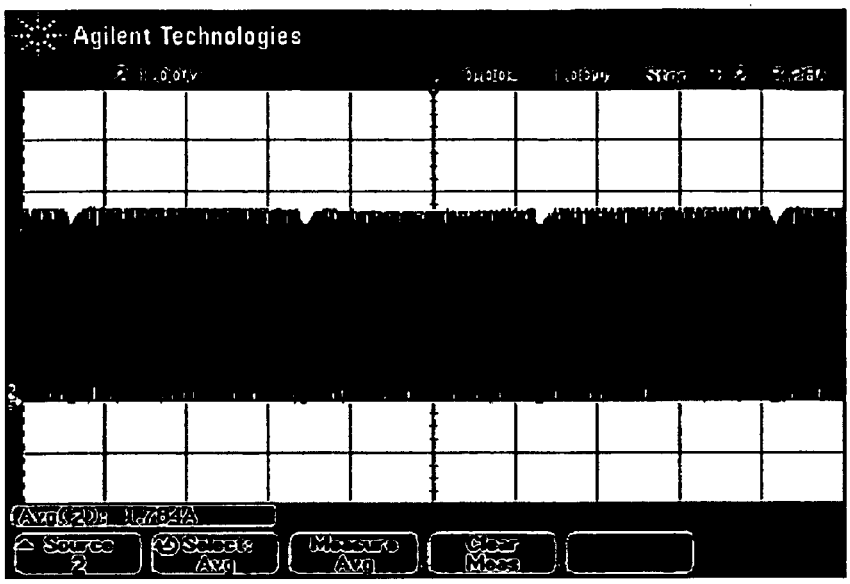
FIG. 4 is a wave diagram of the current through the step-down inductor in the preferred embodiment disclosed in FIG. 1.
Figure 5:
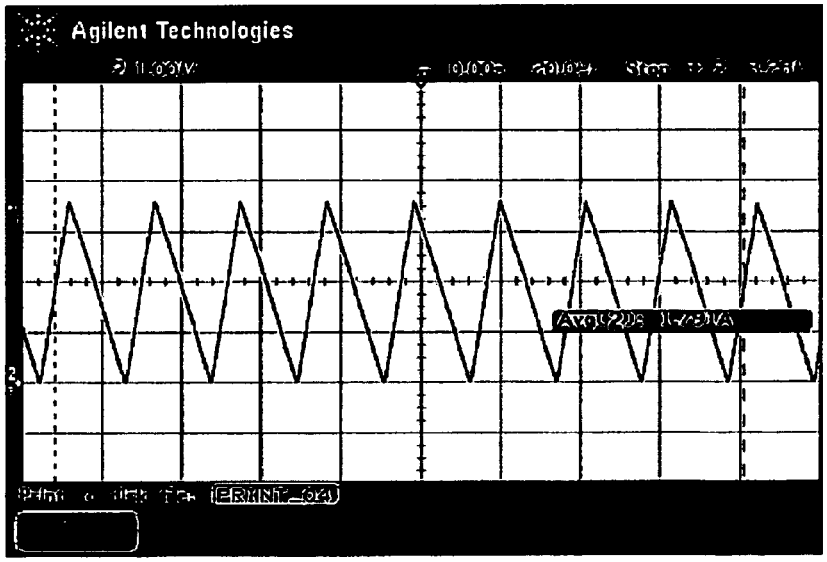
FIG. 5 is a local enlarged wave diagram of the current through the step-down inductor in the preferred embodiment disclosed in FIG. 1.
Figure 6:
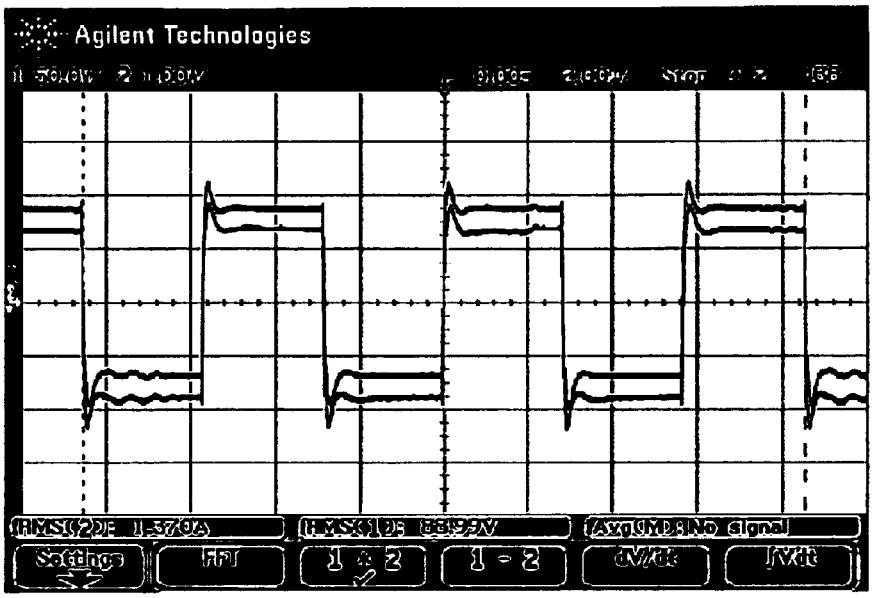
FIG. 6 is a wave diagram of the voltage and the current of the metal halide lamp in the preferred embodiment disclosed in FIG. 1.

Referring to FIGS. 1 and 2, the principle of the circuitry according to the present invention is specified as follows. A commercial electric voltage Vi is applied to a filter circuit consisting of an inductor Lm and a capacitor Cm and then further rectified with a full-wave rectifier Dr. The step-up converter 20 uses a transistor switch Q1 for operating an inductor L1 in a continuous boundary conductive mode by charging the inductor L1 alternatively, thereby producing a DC potential difference across two terminals of a capacitor Cdc that is higher than the peak value of the input voltage signal. The DC voltage is controlled by a step-down converter 30 consisting of a transistor switch Qb, an inductor Lb, a diode Db and a capacitor Cb for providing a steady current to the metal halide lamp 60. The energy-storage inductor Lb is operated in a continuous boundary current mode for lessening the power loss by the transistor switch Qb, as shown in FIGS. 4 and 5. Finally, the steady current from the step-down converter 30 is processed through the full-bridge DC-AC converter 40 that comprises transistor switches Q3, Q4, Q5 and Q6 for generating an AC current. The AC current activates a steady alternating voltage having a square wave form across two terminals of the metal halide lamp 60, as shown in FIG. 6. The high-voltage ignition circuit 50 uses circuit elements including a step-up transformer and a capacitor to produce a high electric voltage more than 3 kV to discharge a metal halide lamp. The micro processor 70 controls the conducting rate of the transistor switch Qb according to the voltages across the resistors R1, R2, achieving the function of power regulation.

Further, the electronic ballasts for metal halide lamps of the prior art use a power-factor correction circuit comprising a step-up converter for jumping input voltage and correcting the power factor at the same time. micro processors for specific purposes can be used to operate a step-up converter in the continuous boundary current mode, which can maintain a fixed DC output voltage under large variations in input voltage. The present invention utilizes the same micro processor controlling the power factor circuits for controlling the switch of a step-down converter. Since the micro processors are common and cheap in the market, the present invention is advantageous in low production cost and low complexity.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A three-stage electronic ballast for metal halide lamps, comprising:

a filter and rectification circuit connected to an input voltage source terminal for suppressing electromagnetic disturbances and rectifying an input voltage signal;

a step-up converter disposed after said filter and rectification circuit, said step-up converter further comprising a push-pull transistor, a step-up inductor and a rectification diode and a filter capacitor;

a step-down converter disposed after said step-up converter, said step-down converter further comprising an inductor, a diode, a capacitor and a transistor switch, said step-down converter controlling the current in said inductor at the boundary of continuity and discontinuity so as to lessen power loss and enhance operation efficiency;

a DC-AC converter disposed after said step-down converter for providing an alternating square-wave voltage to a metal halide lamp;

an ignition circuit using circuit elements including a step-up transformer and a capacitor to generate an electric voltage up to 3 kilo volts for discharging said metal halide lamp; and a micro processor for controlling the conducting rate of said step-down converter according to the product of output voltage and current of said step-down converter, whereby power regulation can be achieved;

whereby said three-stage electronic ballast for metal halide lamps can force said inductor in said step-down converter to operate in a continuous boundary current mode, whereby the peak value of said inductor current will be decreased, and whereby said transistor switch switches under zero current, significantly reducing power loss in switching.

2. The three-stage electronic ballast for metal halide lamps of claim 1 wherein the output power of said metal halide lamp is calculated and controlled by said micro processor to attain a constant value regardless of the characteristic of said metal halide lamp, and wherein said micro processor automatically turns off said switch of said step-down converter when said metal halide lamp cease to operate for protecting said electronic ballast.

3. The three-stage electronic ballast for metal halide lamps of claim 1 wherein said step-up converter and said step-down converter are driven by the same driving integrated circuits; said driving integrated circuit for said step-up converter achieves stabilizing output voltage and enhancing power factor so as to operate the current in said step-up converter at the boundary between continuity and discontinuity; said driving integrated circuit for said step-down converter achieves lessening the peak current value in said switch and operating the current in said step-down converter at the boundary between continuity and discontinuity regardless of the characteristic of said metal halide lamp, thereby lessening the power loss in said step-down converter.

* * * * *